US005666126A

United States Patent [19]

Lange

[11] Patent Number: 5,666,126

[45] Date of Patent: Sep. 9, 1997

[54] MULTI-STAGED ANTENNA OPTIMIZED FOR RECEPTION WITHIN MULTIPLE FREQUENCY BANDS

[75] Inventor: Mark Lange, Oxnard, Calif.

[73] Assignee: California Amplifier, Camarillo, Calif.

[21] Appl. No.: 529,539

[22] Filed: Sep. 18, 1995

[51] Int. Cl.[6] ..... H01Q 13/00; H01Q 11/10

[52] U.S. Cl. ..... 343/781 R; 343/792.5; 343/840

[58] Field of Search ..... 343/792.5, 795, 343/781 R, 840, 872

[56] References Cited

U.S. PATENT DOCUMENTS

| | | | |
|---|---|---|---|
| 3,147,479 | 9/1964 | Williams | 343/792.5 |
| 3,193,831 | 7/1965 | Yang | 343/792.5 |
| 3,277,490 | 10/1966 | Williams | 343/840 |
| 3,389,396 | 6/1968 | Minerva et al. | 343/792.5 |
| 3,573,839 | 4/1971 | Parker | 343/792.5 |
| 3,599,217 | 8/1971 | Grant | 343/792.5 |
| 3,765,022 | 10/1973 | Tanner | 343/792.5 |
| 3,868,689 | 2/1975 | Liu et al. | 343/101 |
| 4,167,009 | 9/1979 | Schwartz | 342/12 |
| 4,198,639 | 4/1980 | Killion | 343/727 |
| 4,342,035 | 7/1982 | Anderson et al. | 343/792.5 |
| 4,862,185 | 8/1989 | Andrews et al. | 343/781 R |
| 4,982,197 | 1/1991 | Villaseca et al. | 343/792.5 |

FOREIGN PATENT DOCUMENTS

| | | | |
|---|---|---|---|
| 1929451 | 12/1970 | Germany | 343/792.5 |
| 2156751 | 3/1980 | Germany | 343/792.5 |
| 0034384 | 8/1980 | Germany | 343/792.5 |
| 0976807 | 12/1964 | United Kingdom | 343/792.5 |

*Primary Examiner*—Donald T. Hajec
*Assistant Examiner*—Tan Ho
*Attorney, Agent, or Firm*—Freilich, Hornbaker, Rosen

[57] ABSTRACT

An antenna suitable for use at subscriber sites in a television distribution system having a high front-to-back ratio and optimized for reception within multiple frequency bands. The antenna is comprised of multiple tapered antenna stages including a primary antenna stage for receiving a primary frequency band and a coupling antenna stage for matching the impedance of the primary antenna stage to either a coaxial cable or downconverter electronics. The multiple antenna stages are alternatively formed from either a stamping of a metal sheet or a double sided printed circuit board.

14 Claims, 9 Drawing Sheets

MULTI-STAGED ANTENNA OPTIMIZED FOR RECEPTION WITHIN MULTIPLE FREQUENCY BANDS

BACKGROUND OF THE INVENTION

The present invention relates to antennas suitable for use at subscriber sites in a television distribution system for receiving microwave signals.

Subscription television service is typically provided either by hardwired cable systems or by "wireless cable" over-the-air systems. Wireless cable systems generally transmit within multiple bands of microwave frequencies, e.g., the 2.15 to 2.162 GHz Multipoint Distribution System (MDS) Band, the 2.4 to 2.4835 GHz Industrial Scientific Medical (ISM) Band and the 2.5 to 2.686 GHz Multichannel Multipoint Distribution System/Instructional Television Fixed Service (MMDS/ITFS) Band. All such microwave links are subject to the detrimental effects of multipath and competing source interference. In order to reduce the effects of interfering sources while obtaining a low cost to performance ratio, it is desirable to control antenna parameters such as the side lobe level, the front-to-back ratio, and the cross polarization level.

A typical prior art dipole feed antenna 10 used in a television distribution system (as shown in FIG. 1A) consists of a parabolic wire grid reflector 12 fed by a dipole 14 with a metal splash plate 16 placed approximately a quarter wavelength (relative to the center frequency of its desired frequency band) away from the dipole 14 on the opposite side from the reflector 12. The dipole 14 is typically placed within a radome 18 and positioned in front of the reflector 12 with a hollow metal tube 20. The tube 20 typically accommodates either a coaxial cable 22 or a downconverter. U.S. Design Pat. No. 269,009 and 268,343 respectively show typical examples of reflectors and radomes found in the prior art.

This use of the dipole 14 with the splash plate 16 typically presents some difficulties for feeding the reflector 12. While the purpose of the splash plate 16 is to increase the sensitivity of the dipole 14 towards as compared to away from the reflector 12, i.e., the front-to-back ratio, the measured radiation pattern shows that typical front-to-back ratio of this type of dipole represents an undesirable signal loss due to the lack of sensitivity of the dipole 14 in the direction of the reflector 12. Another typical drawback to using the splash plate 16 near the dipole 14 is that it blocks a portion of the signal coming into the reflector 12, reducing its effective area as well as forming a discontinuity in the electric field distribution impinging on the reflector surface.

Another class of prior art antennas includes log periodic (LP) antennas as described in Chapter 14 of the "ANTENNA ENGINEERING HANDBOOK Third Edition" by Richard C. Johnson, which is herein incorporated by reference. FIG. 1B, a reproduction of FIGS. 14–32 of the aforementioned reference, shows a schematic diagram of a typical LP antenna 24 comprised of first and second electrically conductive feed lines 26 and 28 driven by a signal source 30 and a plurality of dipoles 32, 34, 36, 38, 40, 42, 44, 46 and 48 coupled to the feed lines 26 and 28. Each dipole, e.g., dipole 48, is formed from opposing dipole halves, e.g., dipole halves 50 and 52, that are respectively coupled at right angles to the feed lines 26 and 28. A significant feature of the LP antenna 24 is that a single line 54 connecting the end points of each of the dipoles defines a taper $\alpha$ which prescribes the performance of the LP antenna 24. LP antennas are typically used to achieve broad bandwidths, e.g., on the order of several decades. However, the radiation characteristics of LP antennas are not well suited for use as feeds for reflectors since they typically have low gain, a low front-to-back ratio and unequal beamwidths in the two principal planes. While the beamwidths can be made nearly equal by spreading the two halves of the LP antenna apart (see FIGS. 14–30 of the aforementioned reference), this approach typically increases blockage and cross polarization. Additionally, the phase center location of LP antennas typically moves with frequency along the LP antenna, e.g., between a center point 56 of dipole 32 and a center point 58 of dipole 48.

SUMMARY OF THE INVENTION

The present invention is directed to antennas exhibiting high front-to-back ratios and optimized for receiving signals in multiple microwave frequency bands, e.g., those frequency bands used by subscription television systems.

Embodiments of the present invention preferably comprise: 1) a reflector for focusing microwave signals to a focal point in front of said reflector, and 2) an array of dipoles having an essentially fixed phase center positioned essentially coincident with said focal point, wherein said dipole array is comprised of first and second feed lines respectively having diametrically opposed dipole halves coupled at essentially right angles to said feed lines. The dipole array is configured to define a primary stage comprised of a plurality of differently-sized primary dipoles arranged such that their ends define a first taper, and wherein each primary stage dipole is essentially a half wavelength long relative to the center frequency of a primary frequency band. The array further defines a coupling antenna stage comprised of a plurality of differently-sized secondary dipoles arranged such that their ends define a second taper greater than said first taper and wherein a common dipole is shared by said primary and coupling antenna stages.

Dipole array embodiments of the present invention are preferably formed either from stamped sheet metal, e.g., copper, or by conductive tracings on a printed circuit board. In the sheet metal embodiment, a sheet metal stamping is essentially folded back on itself to form the first and second feed lines. In the printed circuit board embodiment, the first and second feed lines are preferably formed by conductive tracings on opposite sides of the board.

Typically, adjacent subscription television systems use different polarization, i.e., vertical or horizontal. Therefore, preferred embodiments of the invention are preferably configured to exhibit low cross polarization levels for rejecting adjacent systems interfering signals.

The novel features of the invention are set forth with particularity in the appended claims. The invention will be best understood from the following description when read in conjunction with the accompanying drawings.

DESCRIPTION OF THE PREFERRED EMBODIMENTS

The present invention is directed to antennas optimized for use within multiple frequency bands and exhibiting high front-to-back ratios, low cross polarization levels, and an essentially fixed phase center. In a preferred application, an embodiment of the present invention can be configured for use by subscription television subscribers to efficiently receive microwave signals in the 2.15 to 2.162 GHz Multipoint Distribution System (MDS) Band, the 2.4 to 2.4835 GHz Industrial Scientific Medical (ISM) Band and the 2.5 to 2.686 GHz Multichannel Multipoint Distribution System/Instructional Television Fixed Service (MMDS/ITFS) Band with performance exceeding that of currently available products at a comparable cost. Embodiments of the present invention are configured in multiple stages corresponding to the previously described frequency bands and provide a unique antenna feed assembly which efficiently illuminates a reflector as a consequence of a high front-to-back ratio, e.g., greater than 20 db.

Figure 1A:
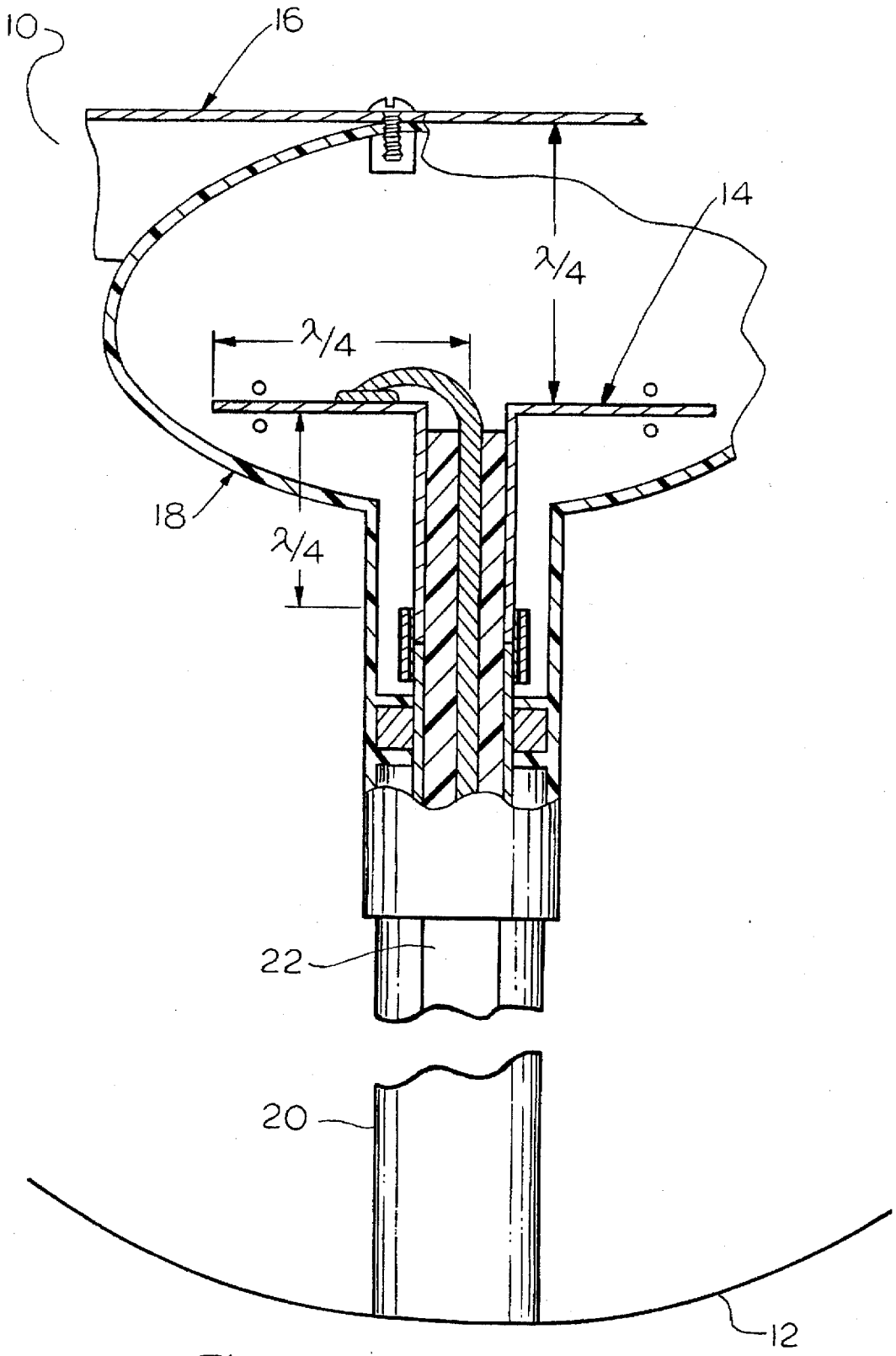
FIG. 1A (PRIOR ART)
FIG. 1A is a cross sectional view of a typical prior art dipole feed antenna.
Figure 1B:
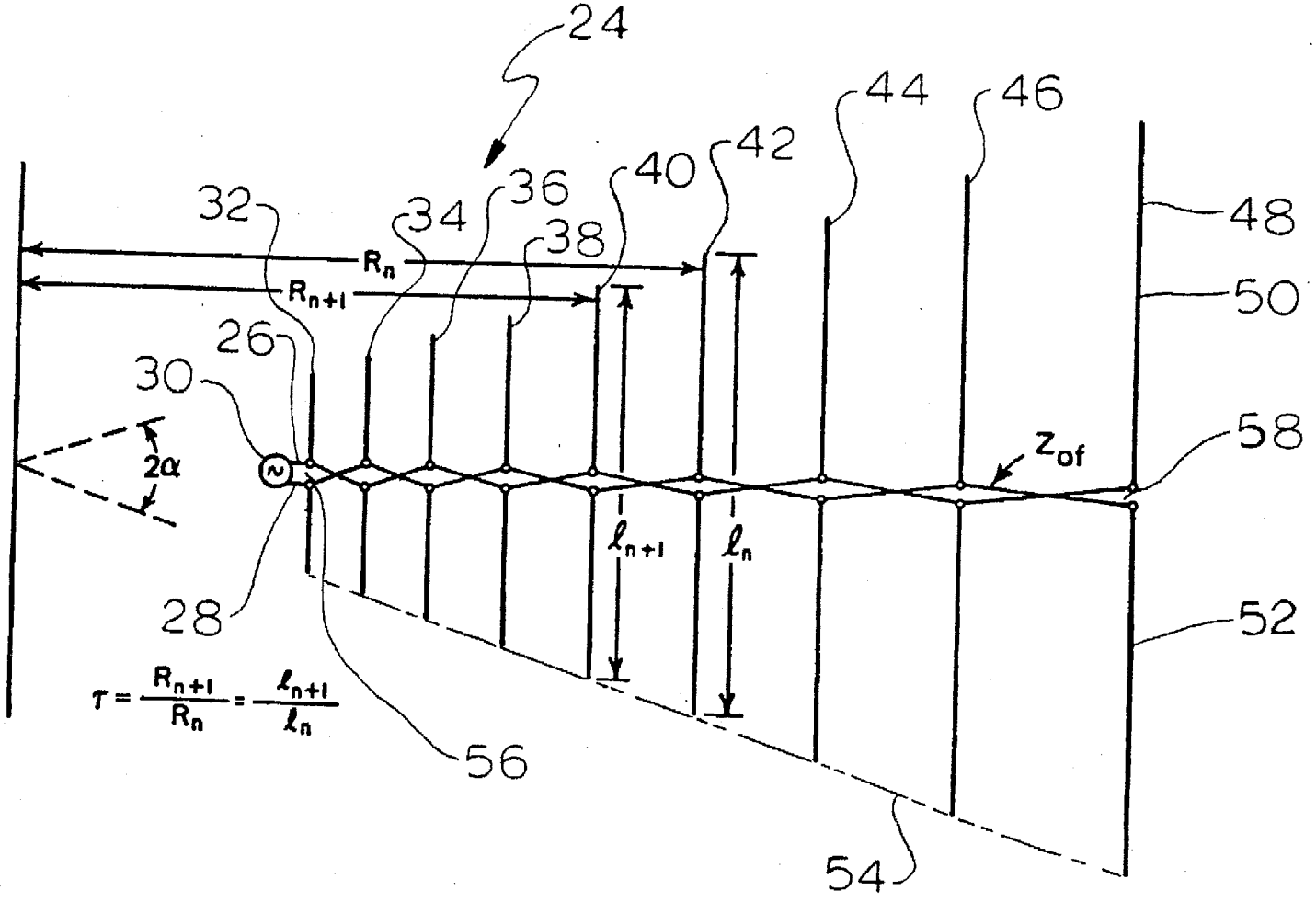
FIG. 1B (PRIOR ART)
FIG. 1B is a schematic diagram of a typical prior art LP antenna comprised of first and second feed lines and a plurality of dipoles having a common taper.
Figure 2:
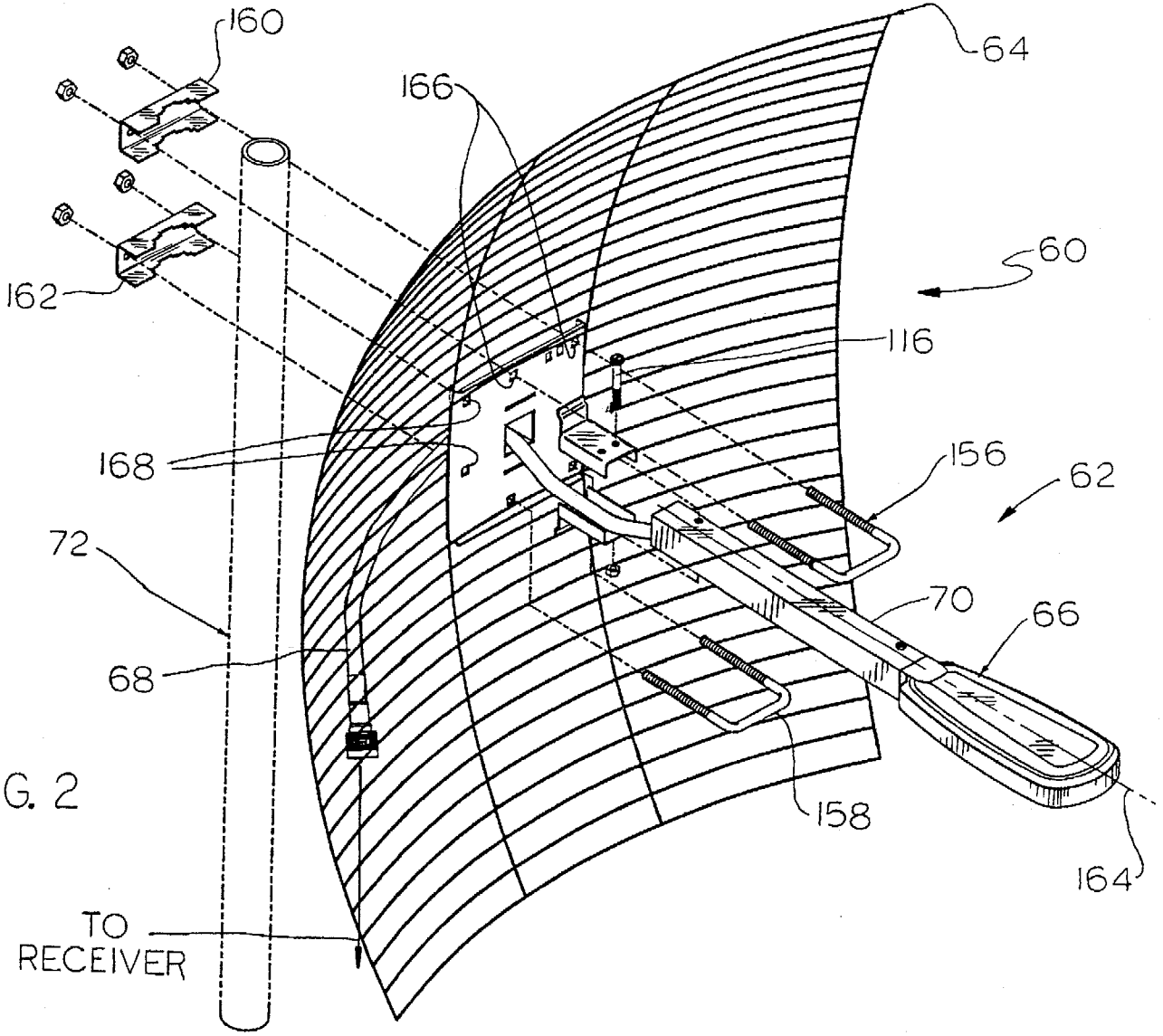
FIG. 2 is a partially exploded view of an antenna assembly having a quasi log periodic (QLP) dipole array positioned at the focal point of a reflector.

FIG. 2 shows a partially exploded view of an antenna assembly 60 primarily comprised of an antenna feed subassembly 62 positioned in front of a reflector 64, preferably parabolic. The primary purpose of the reflector 64 is to focus signals to a fixed focal point located in front of the reflector 64 where it is then received by the antenna feed subassembly 62. (Note, the transmissive properties, i.e., the ability to radiate, and the receptive properties, the ability to receive radiation, of antennas are reciprocal. Thus, while much of the following description refers to receptive properties of an antenna, the description applies equally to transmission.) The antenna feed subassembly 62 is primarily comprised of a dipole array (described further below) having an essentially fixed phase center, a radome 66 encasing the dipole array, a coaxial cable 68 or a downconverter for interfacing the dipole array to a receiver (not shown) and a mounting tube 70 which is used to position the phase center of the dipole array at the focal point of the reflector 64. As will be discussed further below, the antenna assembly 60 is mounted to a mast 72 to aim the antenna assembly 60 to optimally select a desired source signal according to the signal's origin and polarization.

Figure 3:
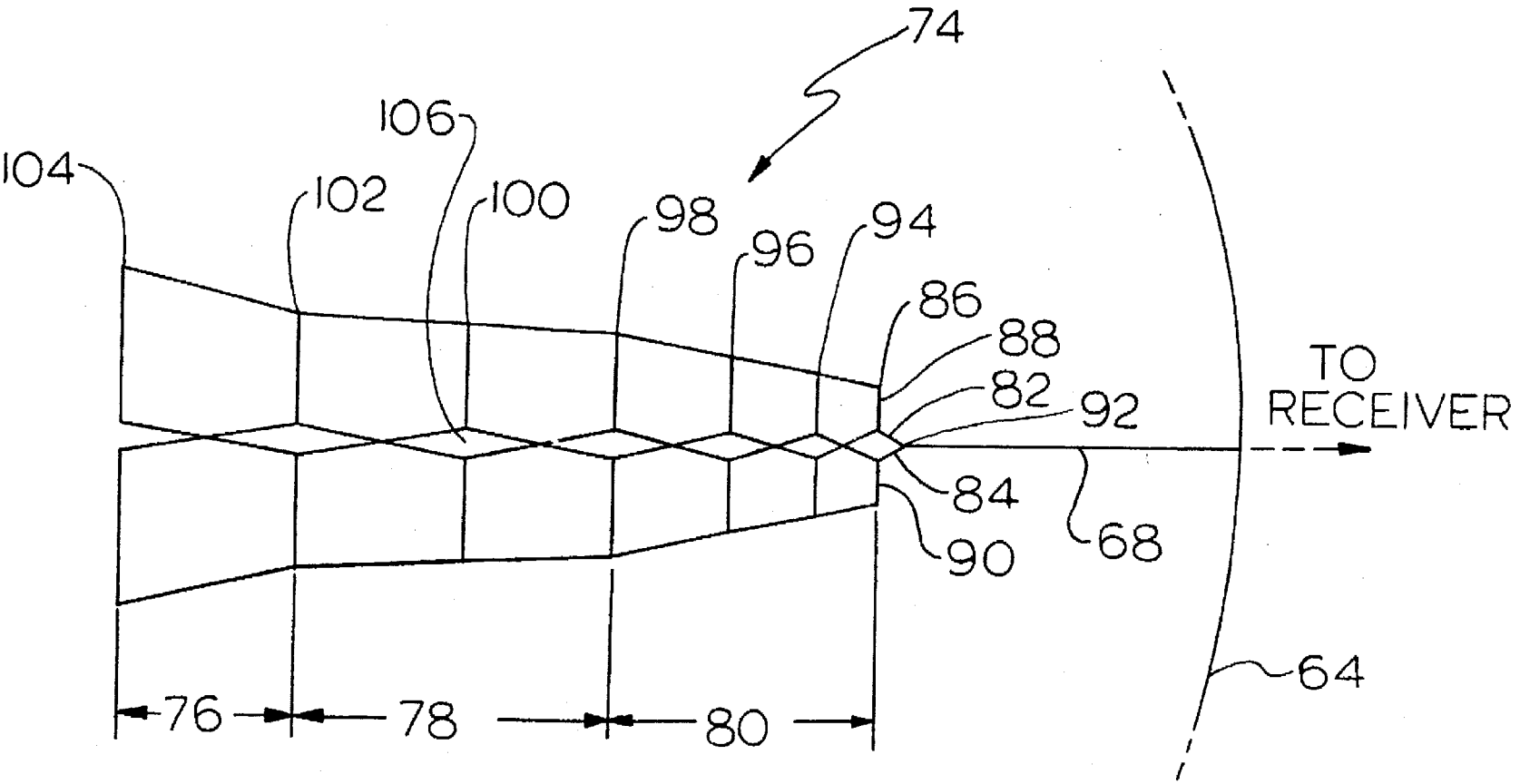
FIG. 3 shows a schematic diagram of a preferred QLP dipole array comprised of three cooperative stages.

FIG. 3 shows a schematic diagram of a preferred dipole array 74, referred to as a quasi log periodic (QLP) dipole array due to its similarity to log periodic (LP) antennas. The QLP dipole array 74 is preferably formed of three cooperative antenna stages: 1) a secondary antenna stage 76 which is optimized for a secondary frequency band, 2) a primary antenna stage 78 which is optimized for a primary frequency band, and 3) a coupling antenna stage 80 which is used to balance the currents and match the impedance of the QLP dipole array 74 to the coaxial cable 68 or downconverter. In an exemplary embodiment, the secondary frequency band is the 2.15 to 2.162 GHz MDS band and the primary frequency band is 2.4 to 2.686 GHZ which includes the 2.4 to 2.4835 GHz ISM and the 2.5 to 2.686 GHz MMDS/ITFS bands.

The QLP dipole array 74 is essentially an array of at least seven dipoles which are coupled to first and second feed lines 82 and 84, which in turn are coupled to the coaxial cable 68. Each dipole, e.g., dipole 86, is formed from a pair of dipole halves, e.g., dipole halves 88 and 90, that are respectively coupled at right angles to the opposing feed lines 82 or 84. Each successive dipole is coupled to opposing feed lines to provide an additional 180° phase shift between dipoles for a total phase shift between dipoles of 270°. When the signal radiates toward the reflector 64, an extra 90° is added to the phase shift between dipoles for a total phase shift of 360°. In this way the signals from each dipole add in phase towards a feed point 92 which is coupled via the coaxial cable 68 to a receiver (not shown). When the signal radiates into the dipoles from the direction opposite the feed point 92, 90° of phase shift between dipole halves is subtracted for a total of 180° of phase shift between dipoles. Thus, the signals received in each dipole cancel with each other when coming from the direction opposite the feed point 92. While more than seven dipoles can be used to further improve performance, it is difficult to achieve a good front-to-back ratio with less than seven dipoles.

The first four dipoles, i.e., the coupling dipoles, 86, 94, 96 and 98 in the QLP dipole array 74, relative to the feed point 92 and comprising the coupling antenna stage 80, are strongly tapered (as denoted by a dashed-line connecting the ends of each constituent dipole). Dipoles 86, 94 and 96 do not significantly radiate since they are much shorter than a half wavelength relative to the primary frequency. However, dipoles 86, 94 and 96 are required to produce a good impedance match across the desired frequency band, resulting in a high return loss, e.g., greater than 15 db. The shorter dipoles 86, 94 and 96 additionally behave as directors, causing a slight phase delay in the radiated signal due to their capacitive nature.

The primary antenna stage 78 is preferably comprised of at least three dipoles 98, 100 and 102, i.e., primary dipoles, having lengths of approximately a half wavelength at the center frequency relative to the primary frequency band. To achieve a good impedance match between the primary antenna stage 78 and the coupling antenna stage 80 and consequently matching the primary antenna stage 78 to the coaxial cable 68, dipole 98 is positioned and sized to be common to both the coupling and primary antenna stages 80 and 78. Thus, the taper of the coupling antenna stage 80 is chosen accordingly. In order to spread the radiated power out among more than just the first of these dipoles, it is necessary to have at least one dipole slightly shorter than a half wavelength and at least one dipole slightly longer than a half wavelength. Thus, the dipoles exhibit only a slight taper (as denoted by a dashed-line connecting the ends of each of the constituent dipoles) from one end to the other, i.e., dipole 98 is shorter than dipole 100 and dipole 100 is shorter than dipole 102. Since different length dipoles will radiate with slightly different phases due to their length (neglecting the phase shift caused by the line length between dipoles), it is also necessary to slightly vary the spacing between dipoles. Due to the minimal taper and close spacing of the dipoles, i.e., 98, 100 and 102 which comprise the primary antenna stage 78, the phase center 106 of the primary antenna stage 78 and the total QLP dipole array 74 remain essentially fixed near the center of dipole 100 throughout the primary frequency band. Thus, the QLP dipole array 74 is preferably positioned to place the phase center 106 at the focal point of the reflector 64.

The secondary antenna stage 76 is primarily comprised of a secondary dipole 104 having a length of approximately a half wavelength corresponding to the second frequency band, e.g., 2.15 to 2.162 GHz, and dipole 102 which is shared with the primary antenna stage 78. However, as will be discussed further below, dipole 104 may be end loaded, as discussed in U.S. Pat. No. 3,732,572, which is herein incorporated by reference. By end loading dipole 104, its length may be reduced below a half wavelength while maintaining a similar frequency response and minimizing blockage of the reflector 64 that is positioned to focus received signals on the QLP dipole array 74. Dipole 104 may be considered to operate cooperativeiy with dipole 102 in the primary antenna stage 78. Dipole 102 is slightly tapered (as denoted by a dashed line connecting the ends of each of the constituent dipoles) from the dimension of dipole 104 and its commonality with the primary and secondary antenna stages 78 and 76 provides an impedance match between. As such dipole 102 can be considered to be a primary and/or a secondary dipole.

Each antenna stage is preferably configured according to design parameters corresponding to a log periodic (LP) antenna, as described in Chapter 14 of the "ANTENNA ENGINEERING HANDBOOK Third Edition" by Richard C. Johnson. As discussed in this reference in association with FIGS. 14–30, the characteristics of an LP antenna can be described according to the equations, $\tau=R_{n+1}/R_n$ and $\epsilon=r_n/R_n$, where the ratios $\tau$ and $\epsilon$ generally correspond to the relative spacings and widths of each dipole, and an angle $\alpha$ which generally corresponds to the taper of each antenna stage. Embodiments of the present invention, preferably exhibit larger tapers $\alpha$ and smaller spacing ratios $\tau$ in the coupling antenna stage 80 as compared to the primary antenna stage 78. Table I shows exemplary values for $\alpha$ and $\tau$.

TABLE I

| | Primary Antenna Stage | Coupling Antenna Stage |
|---|---|---|
| $\alpha$ | 0–5° | 20–40° |
| $\tau$ | .9–.95 | .6–.7 |

In interpreting these values, it should be noted that as $\alpha$ increases, the amount of taper increases and as $\tau$ increases, the spacing between the dipoles increases.

Figure 4A:
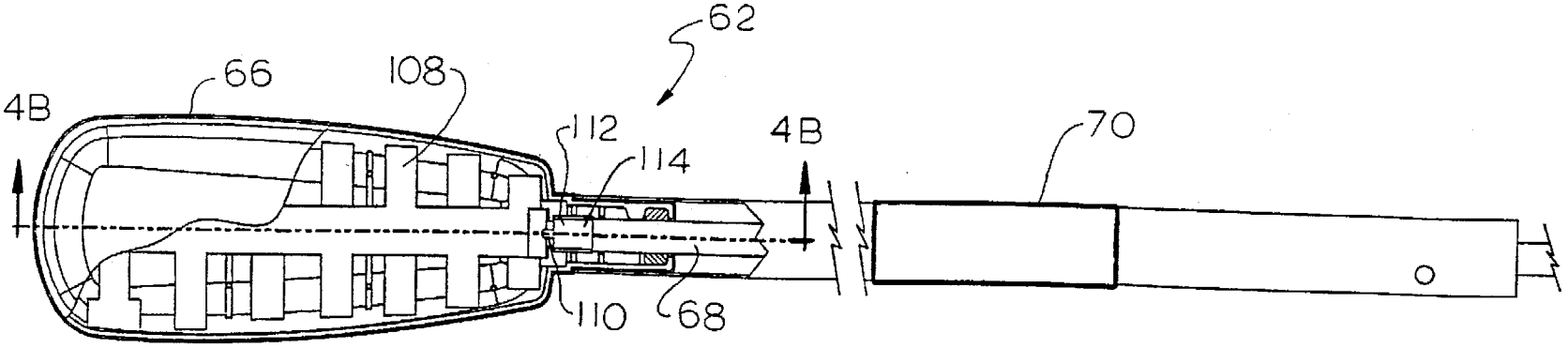
FIG. 4A shows a cutaway view of a preferred antenna feed subassembly using a QLP dipole array implemented with a sheet metal stamping and showing the QLP dipole array within a radome.
Figure 4B:
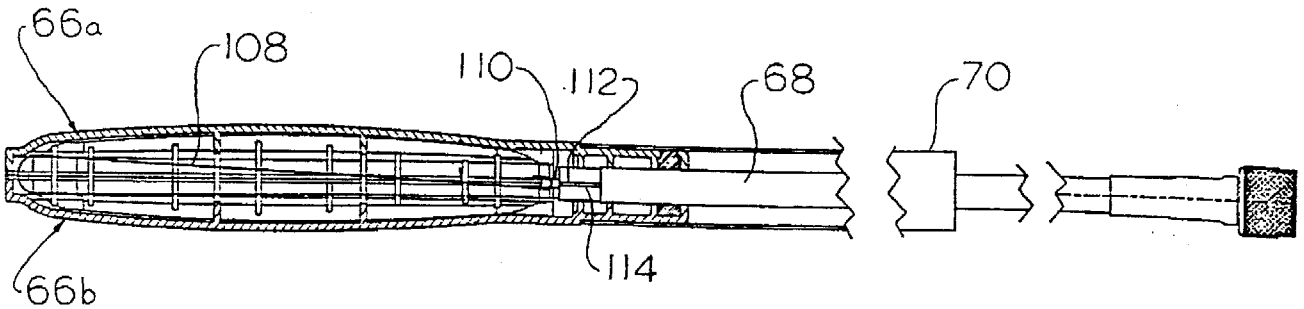
FIG. 4B shows a cross sectional view substantially along the plane 4B—4B of the preferred antenna feed subassembly of FIG. 4A showing the placement of the QLP dipole array within the radome.

FIG. 4A shows a preferred antenna feed subassembly 62 where a QLP dipole array 108, i.e., a stamped QLP dipole array, is implemented (as described below) from a stamping of a metal sheet, e.g., preferably copper. The QLP dipole array 108 is preferably connected to the coaxial cable 68 by soldering the center conductor 110 of the coaxial cable 68 to one end of the QLP dipole array 108 and crimping the outer shield 112 of the coaxial cable 68 to the other end with a metal, e.g., brass, ferrule 114. As shown in FIG. 4B, the QLP dipole array 108 is protected by and supported in place by the radome 66 which is preferably injection molded as two halves **66*a* and 66*b*. The two halves 66*a*, 66*b* of the radome 66 are preferably ultrasonically welded together with the QLP dipole array 108 and a portion of the coaxial cable 68 inside. The end where the coaxial cable 68 comes out of the radome 66 is preferably further sealed with a small amount of all-purpose silicone rubber. As shown in FIG. 2, the phase center 106 of the QLP dipole array 108 is positioned at the focal point of the reflector 64 by the hollow mounting tube 70. The mounting tube 70, which can be either dielectric or metallic, is preferably secured to the radome 66 by a screw 116**.

Figure 5:
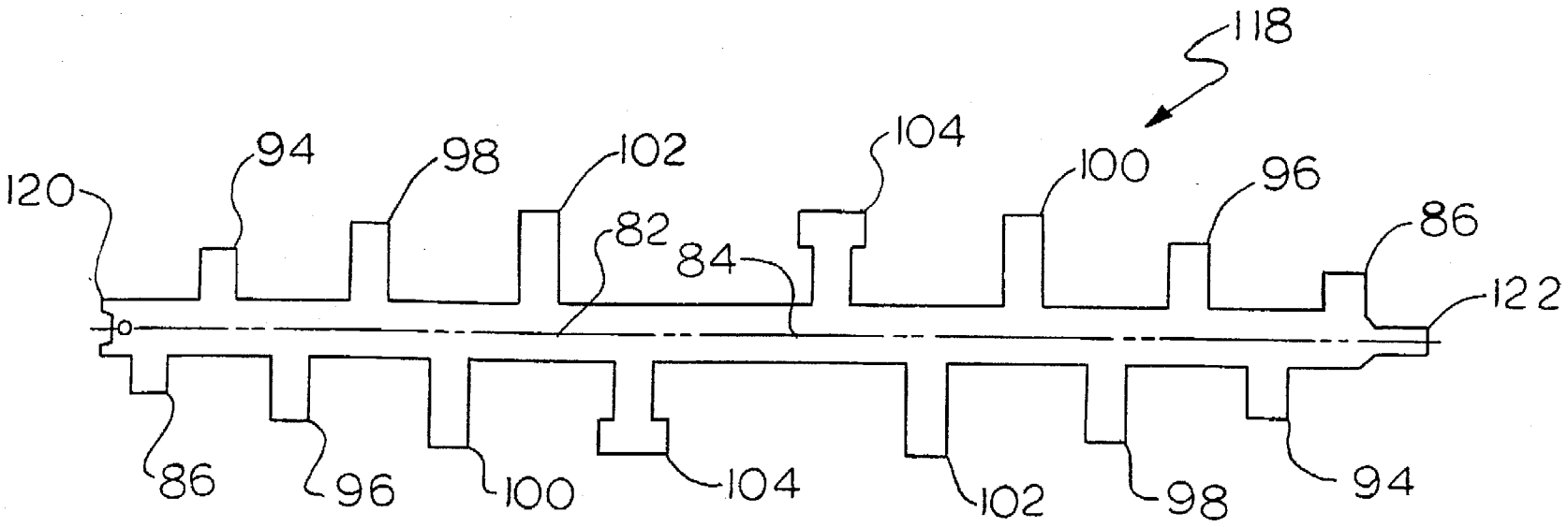
FIG. 5 shows a top view of a preferred stamping used to implement the QLP dipole array.
Figure 6A:
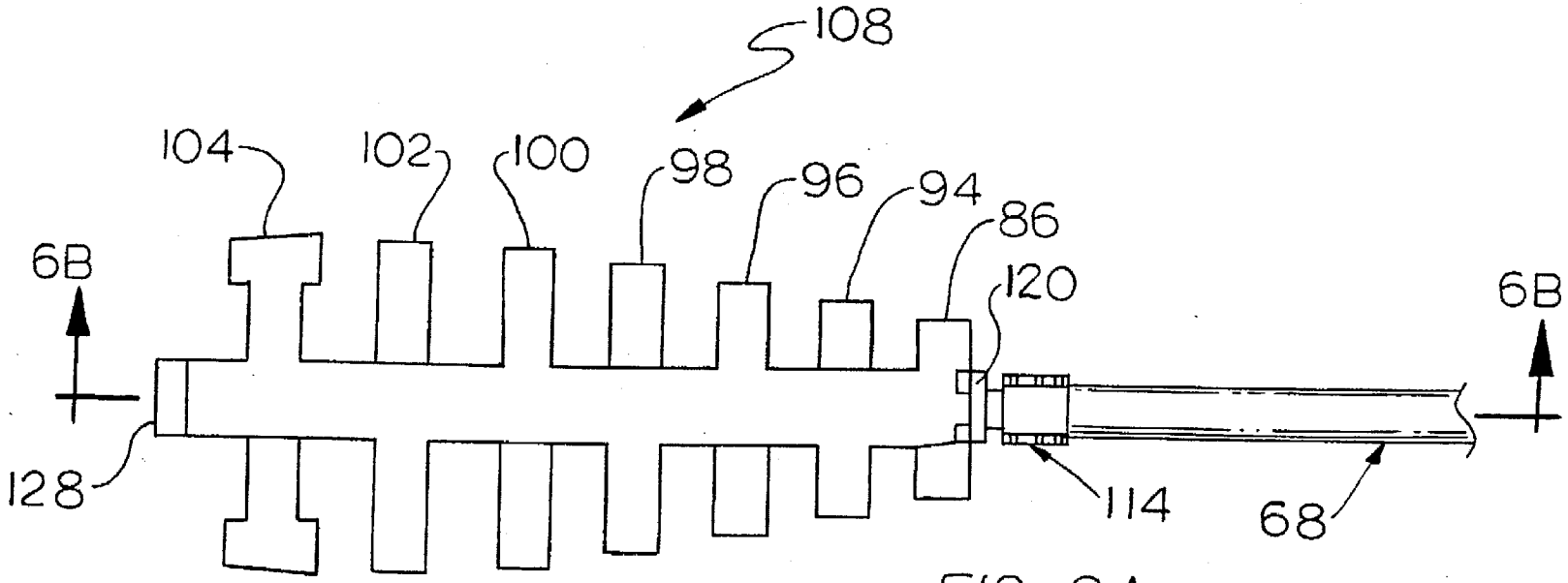
FIG. 6A shows a top view of the QLP dipole array formed by folding the stamping of FIG. 5.
Figure 6B:
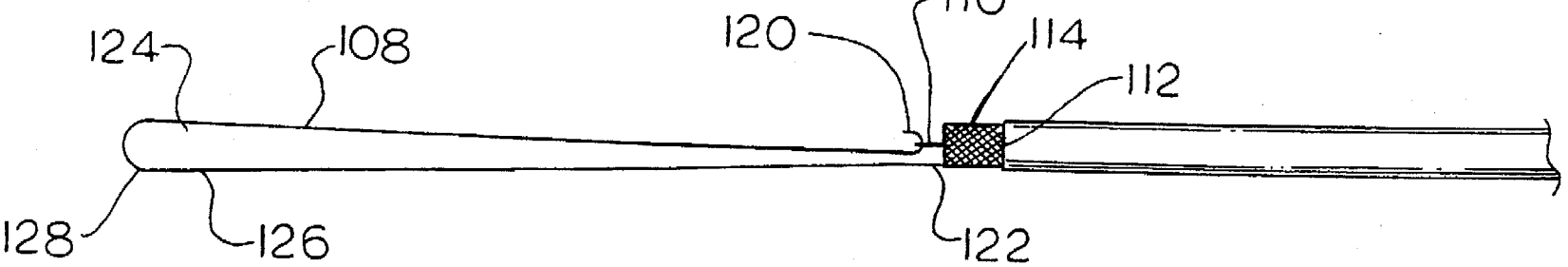
FIG. 6B is a side view of the QLP dipole array of FIG. 6A shown substantially along the plane 6B—6B.

FIG. 5 shows a top view of a metal stamping 118 used to form the QLP dipole array 108. The stamping 118 is folded back on itself to bring its two ends 120 and 122 together as shown in top view FIG. 6A and side view FIG. 6B. The two ends 120 and 122 of the QLP dipole array 108 are then connected to the ends, i.e., the shield 112 and the center conductor 110, of the coaxial cable 68 (shown in FIGS. 6A and 6B). For example, the shield 112 is connected to end 122 and the center conductor 110 is connected to end 120. Once folded, the top 124 and bottom 126 halves of the QLP dipole array 108 form the two feed lines 82, 84 with preferably seven dipoles 86, 94, 96, 98, 100, 102, and 104 spaced along the feed lines and extending outwardly at essentially right angles from the feed lines 82 and 84. A folded end 128 forms a short circuit between the top 124 and bottom 126 halves (and feed lines 82, 84) of the QLP dipole array 108 positioned a quarter wavelength past the last dipole 104. The use of the folded end 128 allows the top 124 and bottom 126 halves to be easily aligned with each other in both axial and transverse directions as well as defining the spacing between the two halves. In addition to the spacing, the short circuit at the folded end 128 one quarter wavelength past the last dipole improves the directivity of the QLP dipole array 108 at the lower end of its frequency band.

As previously discussed, the first few dipoles 86, 94 and 96 of the QLP dipole array 108 are less than half a wavelength of the primary frequency band and are tapered into a length corresponding to the primary frequency band. However, these dipoles improve the return loss of the QLP dipole array 108 and behave as directors for the remaining dipoles. The last dipole 104 in the QLP dipole array 108 is preferably end loaded as an alternative to having a longer dipole and allows the QLP dipole array 108 to fit into a smaller sized radome. End loading the last dipole results in a lower resonant frequency than a dipole of equal length that is not end loaded.

Figure 7:
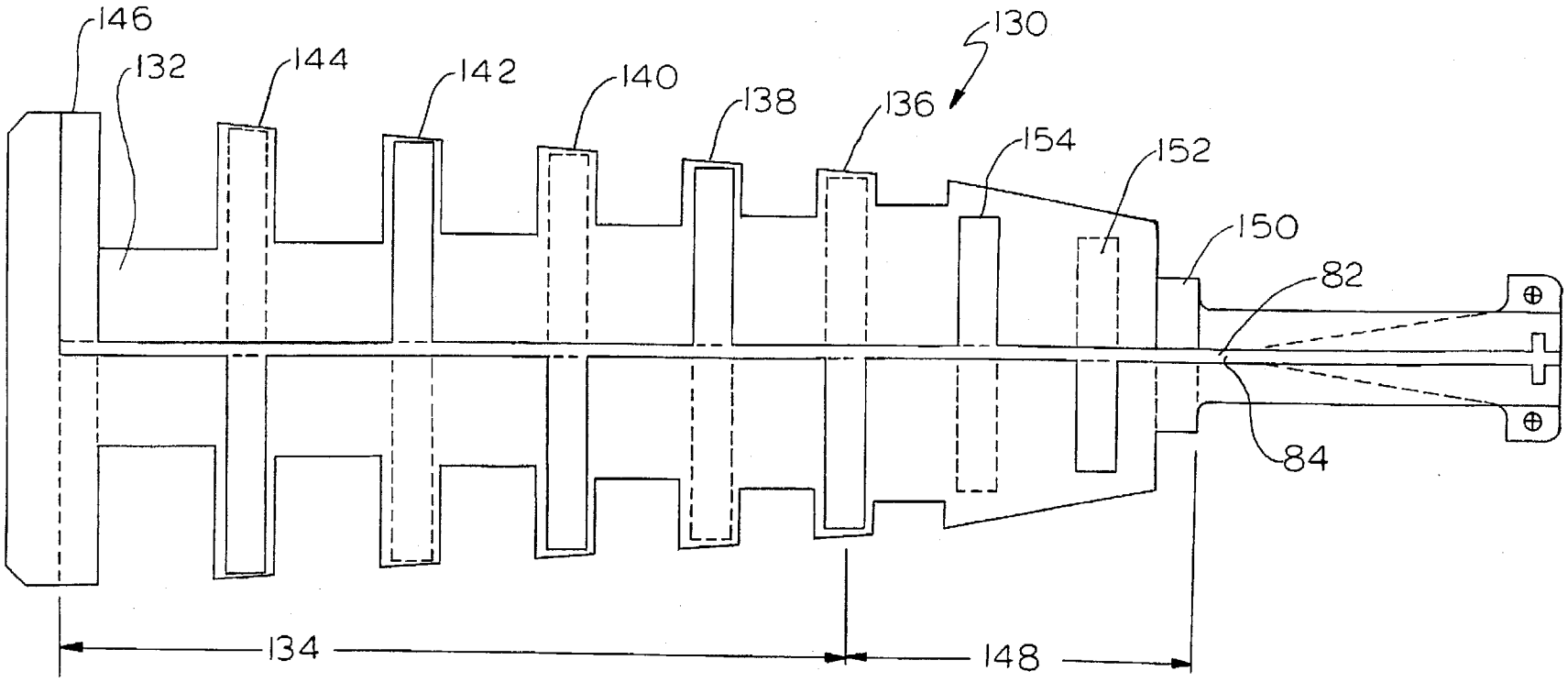
FIG. 7 shows a printed circuit implementation of the QLP antenna.

FIG. 7 shows an alternative embodiment of a QLP dipole array 130, i.e., a printed circuit QLP dipole array, formed on a double sided printed circuit board 132 with the solid lines corresponding to etch on a first side of the printed circuit board 132 and the dashed lines corresponding to etch on its second side. Instead of placing a short circuit a quarter wavelength beyond the last dipole as with a stamped QLP dipole array 108, the end of the QLP dipole array 130 is left open. This is done for two reasons. First, the dielectric substrate of the printed circuit board 132 fully structurally supports the top and bottom halves of the QLP dipole array 130 without any extra structural support. Second, the printed circuit board dielectric between the feed lines 82 and 84 increases the phase shift per unit length, allowing relatively more dipoles to be used within the same area than possible with the stamped QLP dipole array 108. The greater number of dipoles helps to increase the directivity of the QLP dipole array 130 and essentially allows the currents to fully radiate before reaching the end of the QLP dipole array 130. Therefore, a short circuit spaced a quarter wavelength away from the last dipole 146 would have little effect on the radiation pattern as it does with the QLP dipole array 108. In this embodiment, a primary antenna stage 134 of the QLP dipole array 130 is preferably comprised of six dipoles, 136, 138, 140, 142, 144 and 146, that form a slightly tapered LP antenna section corresponding to the desired primary frequency band, e.g., between 2.15 to 2.686 GHz. A coupling antenna stage 148 of the QLP dipole array 130 is preferably comprised of dipoles 150, 152, 154 and 136 and performs the equivalent impedance matching function to that previously described in reference to the coupling antenna stage 80 of the stamped QLP dipole array 108. As previously described in reference to this prior embodiment, the tapers of the adjoining stages are chosen so that the common dipole, i.e., 136, can be considered to be within either antenna stage, i.e., 134 or 148.

The radome 66 which surrounds the QLP dipole array 108 or 130 is preferably formed from a low loss dielectric material which narrows the H-plane radiation pattern of the feed without significantly effecting the E-plane radiation pattern. This results from the fact that most of the dielectric is oriented parallel to the electric field in the H-plane and perpendicular to the electric field in the E-plane. Since the dielectric is close to the QLP dipole array 108 or 130 and oriented parallel to the direction of maximum radiation the radome 66 creates a phase delay along the axis of the QLP dipole array 108 or 130. This results in a lensing effect of the H-plane pattern only. Embodiments of the present invention make use of a properly phased array and the lensing effect of the radome 66 to develop a primary radiation pattern ideally suited for use with the reflector 64.

With reference again to FIG. 2, there is shown a partially exploded view of an embodiment of the present invention used for either vertically or horizontally polarized signals. The antenna feed subassembly 62, alternatively comprised of the stamped QLP dipole array 108 or the printed circuit QLP dipole array 130 within radome 66, is mounted on the tube 70 coupled to the reflector 64 and used to position the phase center of the antenna feed subassembly 62 in front of the reflector 64 at its focal point. As shown in this figure, the reflector 64 is preferably attached to the vertically positioned mounting mast 72 using a pair of U-shaped brackets 156, 158 and matching mating clamps 160, 162 for fixedly coupling the antenna assembly 60 to the mounting mast 72. By choosing its rotational position around the mounting mast 72, the central axis 164 of the QLP antenna assembly 60 is aimed toward a microwave source. Additionally, by choosing between sets of mounting holes 166 and 168, the antenna assembly 60 can be rotated 90° to adapt for either horizontally or vertically polarized signals.

Figure 8:
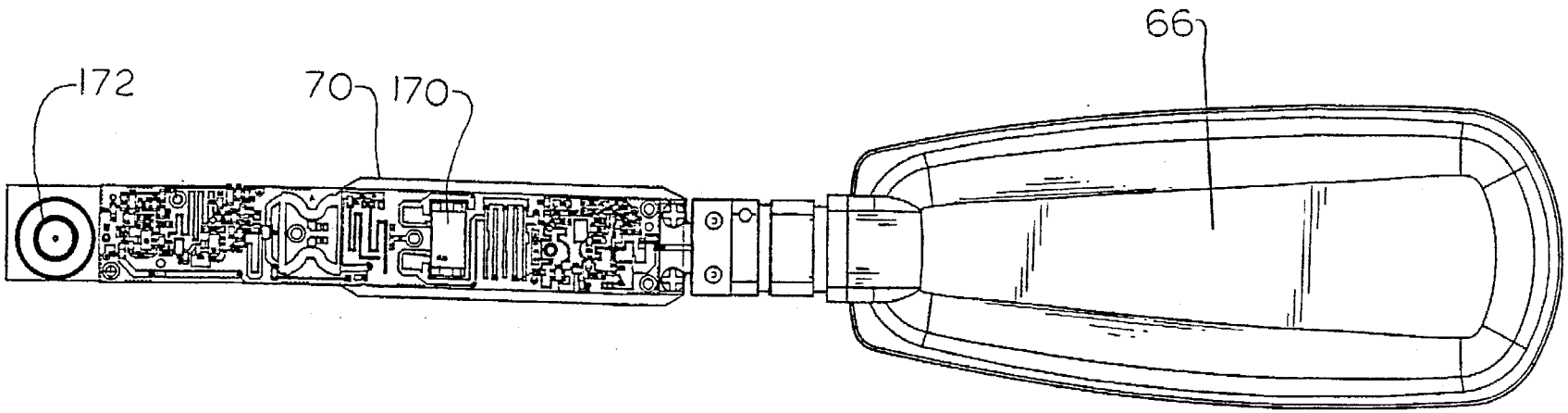
FIG. 8 shows a partially cutaway top view of a antenna feed subassembly implemented with a printed circuit dipole array showing its direct connection with a printed circuit board implementation of a downconverter.

Embodiments of QLP dipole arrays have been shown implemented in two different mediums. In one embodiment, the dipole array is formed from a stamping of a thin sheet of metal, e.g., copper. The connector is then attached to a separate downconverter (not shown). In the second implementation as shown in FIG. 8, the QLP dipole array 130 is etched onto the printed circuit board which is contained within the radome 66 and connected directly to the printed circuit board of a downconverter 170 located within the hollow tube 70. The downconverter is then coupled, preferably via a connector 172, to a coaxial cable for delivery to a receiver. The performance of both implementations are nearly identical except that there is slightly less loss between the QLP dipole array 130 and the downconverter 170 in the printed circuit version without the coaxial cable. The stamped implementation has less loss up to the coaxial cable because it is suspended in free space while the printed circuit version is instead etched onto a dielectric sheet chosen for a particular frequency range.

While implementations of an antenna feed subassembly 62 have been described implemented with a stamped dipole array 108 as well as with a printed circuit board QLP dipole array 130 implementations, other equivalent implementations should be apparent to one of ordinary skill in the art. For example, each of the stages of the antenna could be separately fabricated and then mechanically and electrically coupled together to achieve similar results. Additionally, while a coaxial cable has been shown for coupling the output of the coupling antenna stage or the output of the downconverter to a receiver, other means known to one of ordinary skill in the art, e.g., a wireless transmitter, could be used to deliver the received microwave signals to a receiver.

Although the present invention has been described in detail with reference only to the presently-preferred embodiments, those of ordinary skill in the art will appreciate that various modifications can be made without departing from the spirit and the scope of the invention. For example, by scaling the size of the dipoles, it is possible to use embodiments of the present invention for point-to-point communication systems other than MMDS systems.

I claim:

1. A microwave antenna comprising:

first and second feed lines oriented essentially parallel to each other, each having a remote end and a feed end;

a primary antenna stage positioned proximate to said feed line remote ends for receiving microwave signals within a primary frequency band, said primary antenna stage comprised of a plurality of primary dipoles coupled along said feed lines and wherein each said dipole is comprised of a pair of dipole halves having inner and outer ends and wherein said inner end of a first dipole half is coupled essentially perpendicularly to said first feed line extending in a first direction therefrom and said inner end of a second dipole half is coupled essentially perpendicularly to said second feed line extending in a direction opposite to said first direction;

said plurality of primary dipoles including dipoles of different lengths each substantially equal to a half wavelength in said primary frequency band, said primary dipoles being arranged along said feed lines such that the outer ends thereof define a first taper angle;

a coupling antenna stage positioned proximate to said feed line feed ends comprised of a plurality of coupling dipoles coupled along said feed lines wherein each said dipole is comprised of a pair of dipole halves having inner and outer ends and wherein said inner end of a first dipole half is coupled essentially perpendicularly to said first feed line extending in a first direction therefrom and said inner end of a second dipole half is coupled essentially perpendicularly to said second feed line extending in a direction opposite to said first direction;

said plurality of coupling dipoles including dipoles of different lengths each shorter than a half wavelength in said primary frequency band, said coupling dipoles being arranged along said feed lines such that said outer ends define a second taper angle greater than said first taper angle;

a reflector for focusing microwave signals to a focal point in front of said reflector; and wherein said primary antenna stage has an essentially fixed phase center positioned essentially coincident with said focal point.

2. The antenna of claim 1, wherein said primary and coupling antenna stages share a common dipole.

3. The antenna of claim 1, additionally comprising a coaxial cable coupled to said feed ends of said feed lines proximate to said coupling antenna stage for delivering received microwave signals.

4. The antenna of claim 3, wherein said coaxial cable has a center conductor and a shield each respectively coupled to said feed ends of said first and second feed lines and said first and second feed lines are physically and electrically coupled at said remote ends of said feed lines.

5. The antenna of claim 1, additionally comprising a tubular member for positioning said phase center of said primary and coupling antenna stages to be essentially coincident with said focal point.

6. The antenna of claim 1, wherein said coupling antenna stage is comprised of at least four dipoles and said primary antenna stage is comprised of at least three dipoles with one dipole common to said coupling and primary antenna stages.

7. The antenna of claim 1, wherein said microwave antenna additionally comprises a secondary antenna stage for receiving microwave signals comprised of a plurality of secondary dipoles coupled along said feed lines wherein each said dipole is comprised of a pair of dipole halves having inner and outer ends and wherein said inner end of a first dipole half is coupled essentially perpendicularly to said first feed line extending in a first direction therefrom and said inner end of a second dipole half is coupled essentially perpendicularly to said second feed line extending in a direction opposite to said first direction;

said plurality of secondary dipoles including dipoles of different length and arranged along said feed lines such that said outer ends define a third taper angle different from said first and second taper angles and wherein said secondary antenna stage shares a common dipole with said primary antenna stage.

8. The antenna of claim 7, wherein said coupling antenna stage is comprised of at least four dipoles, said primary antenna stage is comprised of at least three dipoles and said secondary antenna stage is comprised of at least two dipoles and wherein said coupling and primary antenna stages have one dipole in common and said primary and second antenna stages have one dipole in common.

9. The antenna of claim 1, wherein said feed lines and said coupling and primary antenna stages are formed from a stamping of a piece of metal which is then folded essentially in half.

10. The antenna of claim 1, wherein said feed lines and said coupling and primary antenna stages are formed from a pattern etched onto both sides of a double sided printed circuit board.

11. A microwave antenna comprising:

first and second feed lines oriented essentially parallel to each other, each having a remote end and a feed end;

a primary antenna stage positioned proximate to said feed line remote ends for receiving microwave signals within a primary frequency band, said primary antenna stage comprised of a plurality of primary dipoles coupled along said feed lines and wherein each said primary dipole is comprised of a pair of dipole halves having inner and outer ends and wherein said inner end of a first dipole half is coupled essentially perpendicularly to said first feed line extending in a first direction therefrom and said inner end of a second dipole half is coupled essentially perpendicularly to said second feed line extending in a direction opposite to said first direction;

said plurality of primary dipoles including dipoles of different lengths each substantially equal to a half wavelength in said primary frequency band, said primary dipoles being arranged along said feed lines such that the outer ends thereof define a first taper angle;

a coupling antenna stage positioned proximate to said feed line feed ends comprised of a plurality of coupling dipoles coupled along said feed lines wherein each said dipole is comprised of a pair of dipole halves having inner and outer ends and wherein said inner end of a first dipole half is coupled essentially perpendicularly to said first feed line extending in a first direction therefrom and said inner end of a second dipole half is coupled essentially perpendicularly to said second feed line extending in a direction opposite to said first direction;

said plurality of coupling dipoles including dipoles of different lengths each shorter than a half wavelength in said primary frequency band, said coupling dipoles being arranged along said feed lines such that said outer ends define a second taper angle greater than said first taper angle;

wherein said primary antenna stage has an essentially fixed phase center;

a reflector for focusing microwave signals to a focal point in front of said reflector;

a tubular member for supporting said primary and coupling antenna stages in front of said reflector to position said phase center essentially coincident with said focal point; and a downconverter for downconverting received microwave signal coupled to said second ends of said feed lines proximate to said coupling antenna stage; said downconverter located within said tubular member.

12. The antenna of claim 11, wherein said coupling antenna stage is comprised of at least four dipoles and said primary antenna stage is comprised of at least six dipoles with one dipole common to said coupling and primary antenna stages.

13. The antenna of claim 11, wherein said coupling and primary antenna stages are formed from a pattern etched on both sides of a double sided printed circuit board.

14. The antenna of claim 11, additionally comprising a coaxial cable coupled to said downconverter for delivering said received signals.

* * * * *